US005152032A

United States Patent [19]

Davis et al.

[11] Patent Number: 5,152,032

[45] Date of Patent: Oct. 6, 1992

[54] WINDOW SASH BALANCE WITH TENSION AND TORSION SPRING

[75] Inventors: Donald D. Davis, Rochester; William P. Newton, Spencerport; Norman R. Westfall, Rochester, all of N.Y.

[73] Assignee: Caldwell Manufacturing Company, Rochester, N.Y.

[21] Appl. No.: 704,804

[22] Filed: May 23, 1991

[51] Int. Cl.[5] ..... E05D 13/00

[52] U.S. Cl. ..... 16/197; 16/DIG. 16; 49/445

[58] Field of Search ..... 16/197, DIG. 16, 193; 49/445, 447

[56] References Cited

U.S. PATENT DOCUMENTS

| | | | |
|---|---|---|---|
| 2,041,646 | 5/1936 | Larson . | |
| 2,415,614 | 2/1947 | Tappan . | |
| 2,477,069 | 6/1949 | Larson | 16/197 |
| 2,580,705 | 1/1952 | Tappan . | |
| 2,604,655 | 6/1952 | Peremi | 16/197 |
| 2,793,389 | 5/1957 | Larson | 16/197 |
| 2,943,345 | 6/1960 | Ammerman | 16/197 |
| 3,271,812 | 9/1966 | Skolnik | 16/197 |
| 3,286,301 | 11/1966 | Skolnik | 16/197 |
| 3,844,066 | 10/1974 | Nobes . | |
| 4,452,012 | 6/1984 | Deal . | |
| 4,517,766 | 5/1985 | Haltof . | |

FOREIGN PATENT DOCUMENTS

| | | | |
|---|---|---|---|
| 465925 | 5/1937 | United Kingdom | 16/197 |
| 819094 | 8/1959 | United Kingdom | 16/197 |

OTHER PUBLICATIONS

Instruction Sheet for Tilt/Takeout System: "Field Adjustment Procedures for Single or Tandem Balances'-'-Caldwell Manufacturing Company, Rochester, NY.

*Primary Examiner*—Lowell A. Larson
*Assistant Examiner*—Michael J. McKeon
*Attorney, Agent, or Firm*—Eugene Stephens & Associates

[57] ABSTRACT

A spring balance for counteracting the weight of heavy window sashes includes both a torsion spring and a tension spring. The two springs are separated by a rigid tube. One end of each spring is connected to an end of the rigid tube. A spiral member engages a follower carried by the other end of the torsion spring and includes a stop along its length for engaging an anchor carried by the other end of the tension spring. The spiral member can be attached by conventional means to a shoe or other connection to the window sash.

18 Claims, 4 Drawing Sheets

WINDOW SASH BALANCE WITH TENSION AND TORSION SPRING

BACKGROUND

Most window sash balances for counteracting the weight of window sashes are now made with springs. For example, springs exhibiting resilience in the form of either tension or torsion are commonplace in window balances.

Tension springs are generally more effective for exerting lifting forces needed to counteract heavy window sash weight, but the lifting force exerted by such tension springs tends to vary significantly with sash travel, i.e., with the amount the spring is extended. Friction opposing sash movement is controlled to minimize so-called sash "hop" and "drop" at the opposite ends of sash travel.

Torsion springs are often preferred for exerting lesser lifting forces because the torsion springs can be arranged to exert a more constant lifting force over the course of sash travel. Torsional spring force is converted into a lifting force by an elongated spiral member that engages a follower attached to one end of the spring. Although the amount of torque exerted on the spiral member increases with an increasing amount of relative travel between the spiral member and spring, the pitch of the spiral member is varied so that the amount of lifting force exerted by the spiral member remains relatively constant throughout its length of travel.

Tension and torsion springs have also been used together to provide substantially more lifting force than torsion springs while maintaining a more constant lifting force than tension springs. Generally, the torsion spring is mounted within the tension spring, and the variation in pitch along the length of the spiral member is increased to help compensate for the variation in force exerted by the tension spring at different lengths of extension.

For example, there are commercially available balances that include a torsion spring mounted within a tension spring. However, the two springs tend to interfere with each other so that neither spring works exactly as intended, and the available balances tend to perform inconsistently. A much older design found in U.S. Pat. No. 2,041,646 to A. Larson uses a rigid tube to separate the torsion and tension springs so that neither spring interferes with the other. However, similar to the commercially available designs, the balance of Larson is difficult to set in pretension and does not readily accommodate shoe attachments used in tilt and take-out windows.

SUMMARY OF THE INVENTION

We have made improvements to window sash balances of the type that use both tension and torsion springs. However, our new balance is much easier to set in pretension and more readily accommodates shoe attachments that are used in tilt and take-out windows to connect balances to window sashes.

The torsion and tension springs are separated by a rigid tube, and an upper end of at least the torsion spring is connected to the tube. However, the upper ends of both the torsion and tension springs along with the tube are also adapted to be fastened to a window frame. A follower journaled within the tube is connected to a lower end of the torsion spring. A spiral member engages the follower and includes, along another portion of its length, separate connections to the tension spring and shoe attachment.

The connection between the spiral member and the shoe can be formed as a pin or eyelet of the type commonly used to connect the spiral members of conventional torsion spring balances to shoes. The connection between the spiral member and the tension spring can also include a conventional pin or eyelet. However, this other eyelet is sized to engage an anchor mounted at a lower end of the tension spring. The anchor includes an opening that is large enough to allow passage of the eyelet for connecting the spiral member to the shoe but is too small to allow passage of the other eyelet for connecting the tension spring to the spiral member. Thus, the other eyelet forms a stop along the spiral member, and this stop provides for extending the tension spring by the same spiral member movement that winds the torsion spring.

With this invention, the same shoes used for connecting the spiral members of conventional torsion spring balances to window sashes can be used with the combined tension and torsion spring balance of our invention without significant modification. This enables the torsion spring of our balance to be set in pretension according to usual procedures. In that regard, the spiral member of our balance can also include a third eyelet that is used to help release the spiral member from the shoe and to rotate the spiral member for adjusting the tension of the torsion spring.

Our sash balance is assembled in a number of steps including mounting a torsion spring within a rigid tube. An upper end of the torsion spring is attached to the tube, and a follower is attached to the other end of the spring. A spiral member having a stop formed along its length is engaged with the follower. The rigid tube, together with the torsion spring, is inserted within a tension spring. An anchor is attached to a lower end of the tension spring, and the spiral member is inserted through an opening in the anchor until the stop is reached. An upper end of the tension spring is also arranged to be fixed against the rigid tube so that the upper ends of both springs and the tube can be mounted against a window frame.

DRAWINGS

DETAILED DESCRIPTION

Figure 1:
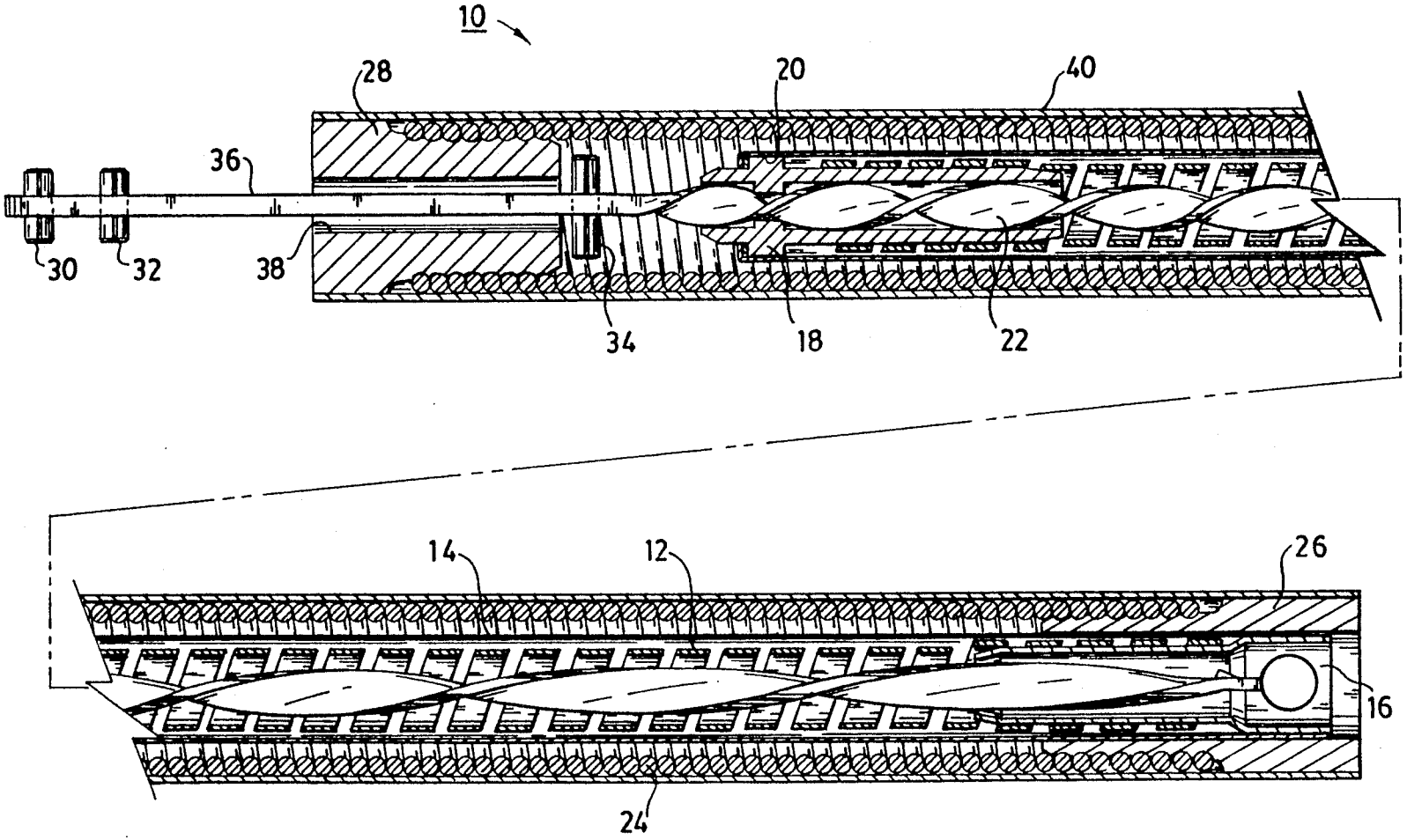
FIG. 1 is a fragmentary cross-sectional view of a first example of our new sash balance.
Figure 2:
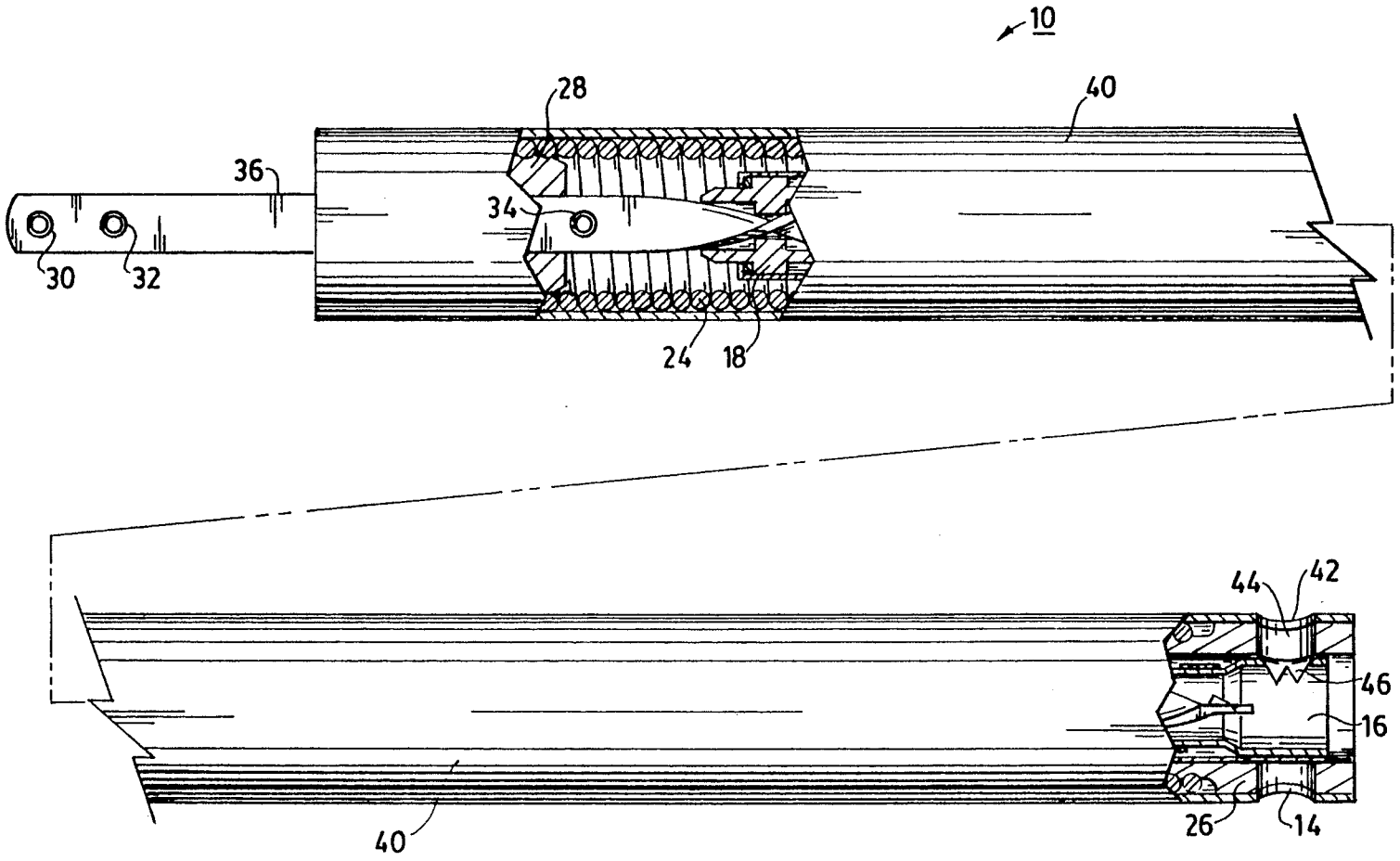
FIG. 2 is another fragmentary view of the same balance but taken only partly in cross section along a line of sight at right angles to FIG. 1.

One example of our invention is shown in the first four drawing figures. Window sash balance 10 includes a torsion spring 12 having an upper end that is connected to a rigid tube 14 by an anchor 16. A follower 18, journaled in a bearing 20 of the tube, is connected to a lower end of the torsion spring 12. A spiral member 22 is threadably engaged with the follower 18 for converting torque of the torsion spring into a linear lifting force directed along the length of the spiral member. The tube 14, together with the torsion spring, is mounted within a tension spring 24. An upper end of the tension spring 24 is attached to the tube 14 by an anchor 26. Another anchor 28 is carried at the lower end of the tension spring 24, but the anchor 28 is not attached to the tube 14.

Three different eyelets 30, 32, and 34 are mounted through an extended portion 36 of the spiral member 22. The eyelets 30 and 32 are dimensioned with respect to an opening formed in the anchor 28 so that they can readily pass through the opening. However, the eyelet 34 is made larger than the eyelets 30 and 32 and forms a stop against the anchor 28 to limit relative movement between the spiral member 22 and the anchor 28 in a direction that both winds the torsion spring 12 and stretches the tension spring 24.

A tube 40 covers the tension spring to protect the spring balance assembly from environmental contamination and to make handling of the spring balance more convenient. An opening 42 is formed in one end of the tube in a alignment with respective openings 44 and 46 of the anchors 26 and 16 to provide for mounting an upper end of the balance 10 in a fixed position against a window frame.

Figure 3:
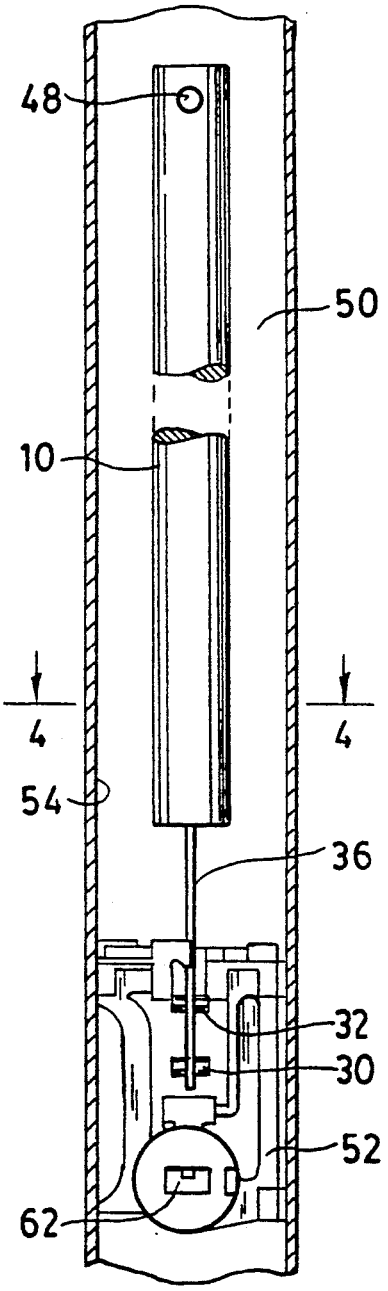
FIG. 3 is a fragmentary cross-sectional view through a portion of a jamb liner within which the balance is mounted.
Figure 4:
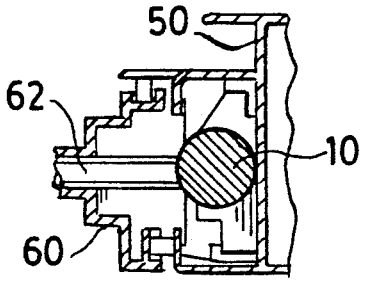
FIG. 4 is an end view of the jamb liner and balance taken along line 4—4 of FIG. 3 showing also a window sash pinned to a sash shoe.

Referring particularly to FIGS. 3 and 4, a screw fastener 48 extends through the openings 42, 44, 46 into a jamb 50 of a fixed window frame. At a lower end of the balance 10, the eyelet 32 on the extended portion 36 of the spiral member is captured within a sash shoe 52 that is arranged to slide within a channel 54 of a conventional jamb liner. The sash shoe 52 connects the balance 10 sash 56 through pin 58. The eyelet 30 is exposed beneath the eyelet 32 to assist with pretensioning the torsion spring in a conventional manner including gripping the spiral member with a conventional tool, releasing the spiral member from the shoe, and turning the spiral member in either of two directions to adjust the amount of tension in the torsion spring.

Preferably, the pretensioning adjustment is made with the amount of tension in the tension spring 24 at a minimum so that the stop 34 can be easily rotated independently of the anchor 28 to avoid imparting any torque to the tension spring 24. It is also important to note that since only the spiral member 22 is connected directly to the sash shoe 52, most of the remaining weight of the balance 10 is supported on the fixed frame and does not add to the mass required for movement with sash 56.

Figure 6:
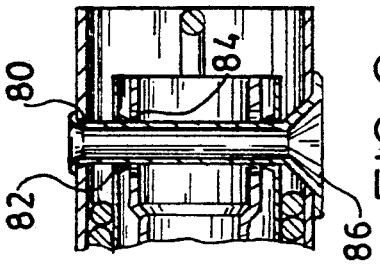
FIG. 6 is a fragmentary cross-sectional, view of an upper end of the second balance along a line of sight at right angles to FIG. 5.
Figure 5:
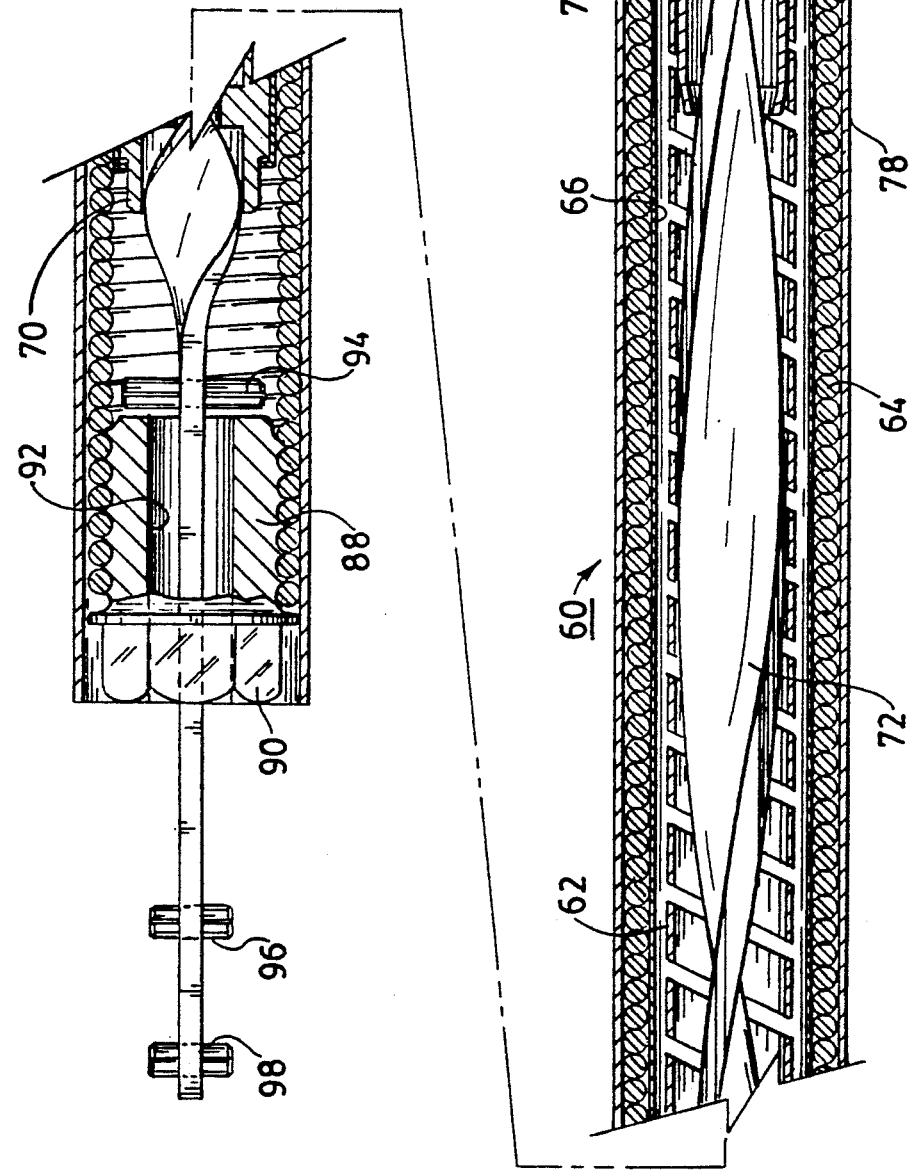
FIG. 5 is a fragmentary cross-sectional view of a second example of our new balance.

Another example of our invention is shown in the remaining drawing FIGS. 5 and 6. Depicted window sash balance 60 is similar in many ways to the previously illustrated balance 10 and is intended to work in much the same way. For example, the balance 60 includes a torsion spring 62 and a tension spring 64 separated by a rigid tube 66. An upper end of the torsion spring 62 is connected to an anchor 68, and a lower end of the same spring is attached to a follower 70. A spiral member 72 is engaged with the follower 70 to convert torsion exerted by the torsion spring 62 into a lifting force.

However, the anchor 68 at the upper end of the torsion spring 62 is made differently from the anchor 16 at the upper end of the torsion spring 12 of balance 10. The anchor 68 has tabs 74 that more securely engage an upper end of the spiral member 72 in a retracted position to hold a pretensioning adjustment of the torsion spring prior to connecting a lower end of the spiral member to a window sash.

In further contrast to balance 10, an anchor is not used to secure an upper end of the tension spring 64. Instead, an integral ring 76 is formed at the upper end of the tension spring 64, and the ring 76 is fit over an end of the rigid tube 66. Outer tube 78 helps to capture the ring 76 in place against the rigid tube 66. Respective openings 80 and 82 of the two tubes 78 and 66, along with an opening 84 in anchor 68, are aligned to receive an eyelet 86 that also helps to secure the upper ends of both springs to the rigid tube.

Anchor 88, attached to a lower end of the tension spring 64, is also different from its counterpart in balance 10. A lower end of the anchor is formed with a hex head 90 for helping to thread an upper end of the anchor into the tension spring. Nevertheless, an opening 92 in the anchor 88 is dimensioned with respect to an eyelet 94 through the spiral member 72 to limit relative movement between the spiral member and tension spring. This enables one or the other of eyelets 96 and 98 through the lower end of the spiral member to effectively attach the tension spring 64 to a window sash.

We claim:

1. A spring balance for counteracting weight of a window sash movable within a window frame comprising:

a torsion spring having first and second ends;

a follower attached to said first end of the torsion spring;

a spiral member threadably engaged with said follower for winding said torsion spring;

a rigid tube enclosing said torsion spring and having first and second ends;

a bearing formed at said first end of the tube rotationally supporting said follower;

a first anchor attached to said second end of the tube holding said second end of the torsion spring against relative rotation;

a tension spring enclosing said rigid tube and having first and second ends;

a second anchor attached to said first end of the tension spring;

said second end of the tension spring and said second end of the tube being adapted for attachment to the window frame;

said spiral member including a first portion that extends out of said tube for attachment to the window sash and a second portion that extends into said tube for engagement with said follower; and said spiral member being further adapted to engage said second anchor for stretching said tension spring simultaneously with one winding of the torsion spring in response to relative movement between the window sash and window frame.

2. The spring balance of claim 1 in which a stop is formed on said spiral member to engage said second anchor in response to movement of said spiral member further out of said tube.

3. The spring balance of claim 2 in which said stop is formed as a first eyelet that is disengaged from said second anchor by movement of said spiral member further into said tube.

4. The spring balance of claim 3 in which said spiral member includes a second eyelet for attaching said spiral member to the window sash.

5. The spring balance of claim 4 in which said spiral member includes a third eyelet for winding and unwinding said torsion spring.

6. The spring balance of claim 4 in which said second anchor includes an opening that is large enough to allow passage of said second eyelet but is too small to allow passage of said first eyelet.

7. A spring balance for a window of the type including a window frame, a sash movable within the frame, and a shoe movable along the frame connecting the spring balance to the sash comprising:

a torsion spring and a tension spring that are separated by a rigid tube and are each adapted for connection to the tube at one of two ends;

a spiral member engaged by a follower carried by the other end of said torsion spring; and said spiral member including first means formed along a length of said spiral member for connecting said spiral member to the shoe and second means formed along the length of said spiral member for engaging the other end of said tension spring and for connecting said tension spring to the shoe.

8. The spring balance of claim 7 further comprising an anchor that is attached to said other end of the tension spring and is engaged by said second means for connecting said tension spring to the shoe.

9. The spring balance of claim 8 in which said anchor includes an opening through which said spiral member extends for connection to the shoe.

10. The spring balance of claim 9 in which said second means includes a stop carried by said spiral member.

11. The spring balance of claim 10 in which said stop limits passage of said spiral member through said anchor.

12. The spring balance of claim 11 in which said stop also limits passage of said spiral member through said follower.

13. The spring balance of claim 11 in which said first means is sized for passage through said opening in the anchor.

14. A method of assembling a spring balance for a window sash movable within a window frame comprising the steps of:

inserting a torsion spring having two ends within a rigid tube;

attaching one end of the torsion spring to the tube and attaching the other end of the torsion spring to a follower journaled within the tube;

inserting a spiral member into the tube in engagement with the follower;

attaching a stop to the spiral member;

inserting the tube within a tension spring having two ends;

attaching an anchor to one end of the tension spring;

inserting the spiral member through an opening in the anchor; and positioning the stop between the follower and the anchor.

15. The method of claim 14 in which the stop is sized larger than the opening in the anchor to restrict movement of the spiral member with respect to the anchor.

16. The method of claim 15 including the further step of attaching a connector to an end of the spiral member for connecting the spiral member to the window sash.

17. The method of claim 16 in which said step of inserting the tube includes inserting the torsion spring, the spiral member, and the stop together with the tube into the tension spring.

18. The method of claim 17 in which said step of inserting the spiral member through the anchor opening includes inserting the connector together with the spiral member through the opening.

* * * * *